US007075770B1

(12) United States Patent
Smith

(10) Patent No.: US 7,075,770 B1
(45) **Date of Patent: *Jul. 11, 2006**

(54) LESS LETHAL WEAPONS AND METHODS FOR HALTING LOCOMOTION

(75) Inventor: Patrick W Smith, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/673,901

(22) Filed: Sep. 28, 2003

Related U.S. Application Data

(63) Continuation of application No. 10/016,082, filed on Dec. 12, 2001, now Pat. No. 6,636,412, which is a continuation of application No. 09/398,388, filed on Sep. 17, 1999, now abandoned.

(51) Int. Cl.
*F41B 15/04* (2006.01)

(52) U.S. Cl. ..... 361/232; 42/1.08; 42/84; 89/1.11; 102/502; 463/47.3

(58) Field of Classification Search ..... 89/1.11; 102/201; 361/232; 42/1.08; 463/47.3
See application file for complete search history.

(56) References Cited

U.S. PATENT DOCUMENTS

| | | | | |
|---|---|---|---|---|
| 2,622,200 A | | 12/1952 | Hoggson | |
| 3,819,108 A | | 6/1974 | Jordan | 231/7 |
| 4,092,695 A | | 5/1978 | Henderson et al. | 361/232 |
| 4,162,515 A | | 7/1979 | Henderson et al. | 361/232 |
| 4,167,036 A | | 9/1979 | Kenney | 363/61 |
| 4,242,715 A | | 12/1980 | Laird | 361/232 |
| 4,253,132 A | * | 2/1981 | Cover | 361/232 |
| 4,370,696 A | * | 1/1983 | Darrell | 361/232 |
| 4,486,807 A | | 12/1984 | Yanez | 361/232 |
| 4,539,937 A | | 9/1985 | Workman | 119/29 |
| 4,541,191 A | | 9/1985 | Morris et al. | 42/1.01 |
| 4,541,848 A | | 9/1985 | Masuda | 55/139 |
| 4,688,140 A | | 8/1987 | Hammes | 361/232 |
| 4,691,264 A | | 9/1987 | Schaffhauser et al. | 361/232 |
| 4,843,336 A | | 6/1989 | Kuo | 340/521 |
| 4,846,044 A | | 7/1989 | Lahr | 89/1.11 |
| 4,872,084 A | | 10/1989 | Dunning et al. | 361/232 |
| 5,067,495 A | * | 11/1991 | Brehm | 607/46 |
| 5,193,048 A | | 3/1993 | Kaufman et al. | 361/232 |
| 5,225,623 A | | 7/1993 | Krasnow | 89/1.1 |
| 5,282,332 A | | 2/1994 | Philips | 42/1.08 |

(Continued)

OTHER PUBLICATIONS

Kenny, John M., "Human Effects Advisory Panel Report of Findings: Sticky Shocker Assessment, PennState, Applied Research Laboratory", Jul. 29, 1999, National Criminal Justice Reference Service, Box 6000, Rockville, MD 20849-6000.

(Continued)

*Primary Examiner*—Jack Keith
*Assistant Examiner*—Daniel Lawson Greene, Jr.
(74) *Attorney, Agent, or Firm*—William R. Bachand

(57) ABSTRACT

A hand-held stun gun incapacitates a human target by generating a series of powerful electrical output pulses of pulse energy of from 0.9 Joules to 10 Joules which generate a series of output current pulses have an RMS current flow of from 100 milliamps to 500 milliamps when the first and second output terminals are applied to a human target. A battery power supply includes an electronic switch, an energy storage capacitor and a transformer for converting low voltage, direct current into a series of high voltage output pulses.

46 Claims, 9 Drawing Sheets

U.S. PATENT DOCUMENTS

| | | | | | |
|---|---|---|---|---|---|
| 5,317,155 | A | | 5/1994 | King | 250/324 |
| 5,388,603 | A | | 2/1995 | Bauer et al. | 135/16 |
| 5,457,597 | A | * | 10/1995 | Rothschild | 361/232 |
| 5,467,247 | A | | 11/1995 | De Anda et al. | 361/232 |
| 5,473,501 | A | | 12/1995 | Claypool | 361/232 |
| 5,579,202 | A | | 11/1996 | Tolfsen et al. | 361/232 |
| 5,625,525 | A | | 4/1997 | Coakley et al. | 361/232 |
| 5,698,815 | A | | 12/1997 | Ragner | 102/502 |
| 5,786,546 | A | | 7/1998 | Simson | 102/438 |
| 5,801,617 | A | * | 9/1998 | Langner et al. | 340/426.31 |
| 5,831,199 | A | | 11/1998 | McNulty, Jr. et al. | 89/1.11 |
| 5,936,183 | A | | 8/1999 | McNulty, Sr. | 89/1.11 |
| 5,955,695 | A | | 9/1999 | McNulty, Sr. | 89/1.11 |
| 5,962,806 | A | * | 10/1999 | Coakley et al. | 102/502 |
| 6,022,120 | A | | 2/2000 | Chang | 362/109 |
| 6,404,613 | B1 | | 6/2002 | Dowling et al. | 361/232 |
| 6,493,588 | B1 | | 12/2002 | Malaney | 607/46 |
| 6,636,412 | B1 | * | 10/2003 | Smith | 361/232 |
| 6,880,466 | B1 | * | 4/2005 | Carman | 102/502 |

OTHER PUBLICATIONS

Vasel, Edward, "Sticky Shocker", J203-98-0007/2990, Jaycor, San Diego, CA.

T' Prina Technology, "Stun Guns, An Independent Report", 1994, T' Prina Technology, Gateway Station, Aurora, CO 80044-1126 U.S.A.

Murry, John, "Taser Technoloogy", ISBN 0-9648984-0-3, 1997, Whitewater Press, 2301 Whitewater Creek Road, Whitewater, CO 81527.

JAYCOR, "Excutive Summary, Excerpt from Jaycor Report", Jaycor, San Diego, CA.

* cited by examiner

| BRAND | PULSE AMPLITUDE (mA RMS) | PULSE WIDTH (μSEC) |
|---|---|---|
| JAYCOR SS | 42.0 | 1.00 |
| ZFORCE I | 29.0 | 1.60 |
| Z FORCE III | 31.9 | 1.69 |
| ZFORCE IV | 25.3 | 1.81 |
| TP65kV | 26.8 | 2.07 |
| TP120kV | 25.7 | 3.03 |
| MYOTRON | 64.7 | 3.20 |
| Om120kV | 38.2 | 6.17 |
| Om150kV | 29.6 | 7.13 |
| Om SB | 29.8 | 7.52 |
| INVENTION | 162.48 | 13.00 |

FIG. 3

LESS LETHAL WEAPONS AND METHODS FOR HALTING LOCOMOTION

CROSS-REFERENCE TO RELATED APPLICATIONS

This application is a continuation application of co-pending application Ser. No. 10/016,082, filed Dec. 12, 2001 now U.S. Pat. No. 6,636,412, which is a continuation of application Ser. No. 09/398,388, filed Sep. 17, 1999, now abandoned.

FIELD OF THE INVENTION

This invention relates to apparatus and methods for preventing the locomotion of a human being or animal. More particularly, the invention relates to apparatus and methods for assuring, with a high degree of certainty, that a police officer or other law enforcement agent can prevent an attacker or other violent individual from reaching and inflicting bodily harm on the police officer.

BACKGROUND OF THE INVENTION

The use of electricity to disable human beings and other living targets is well known. In the middle 1800's, electricity was directed through a harpoon to electrocute a whale. Electrocution also came into use as a method of carrying out a death sentence resulting from the commission by a prisoner of a serious crime. Various methods of applying lethal electrical pulses are well documented. A weapon for applying non-lethal electrical pulses to disable an attacker is also known. The conventional weapon launches a first dart and a second dart. Each dart remains connected to the weapon by an electrically conductive guide wire. The darts strike an individual. Electrical pulses from the weapon travel to the first dart, from the first dart through the individual's body, into the second dart, and return to the weapon via the electrically conductive wire attached to the second dart. The electrical pulses occur at a rate of from 2 to 10 pulses per second, are each about 20 kilovolts, and each deliver from 0.01 to 0.5 joule. U.S. Pat. No. 4,253,132 issued in 1981 describes such a dart weapon. That patent also suggests that pulses in the range of 0.01 to 0.5 joule induce involuntary muscular contractions.

Since about 1981, it has also been known that a certain minor percentage of individuals struck with a conventional dart weapon are not immobilized and can "walk through" the electrical pulses and continue an attack, despite being struck with darts from the weapon. The ability of some individuals to "walk through" the electrical pulses was thought to be an anomaly and usually was not taken seriously because the weapon was effective with and stopped most individuals, and because the weapon when used appeared to "knock down" an individual or animal or appeared to cause the individual or animal to fall. The weapon would also sometimes appear to cause the skin of a human being or animal to twitch. Consequently, it was assumed that the human being or animal was truly physically incapacitated.

I have discovered that an individual can be readily trained to "walk through" 0.01 to 0.5 joule pulses delivered by a conventional dart weapon. I have been involved in training over 20 individuals. In each case the individual was, by focusing on a goal, able to ignore and overcome any discomfort from the dart weapon and to continue to walk, run, or attack. The individual did not lose his or her locomotion. In addition, several cases have been reported where the failure of a conventional dart weapon led to the death of an individual because police officers had to resort to lethal force when the dart weapon failed to stop the individual. It appears that conventional dart weapons cause an individual to fall down by activating sensory neurons and by producing in an individual a psychological reaction which strongly suggests to the individual that he or she is being incapacitated. The discovery that an individual can overcome a conventional dart weapon and continue his or her locomotion suggests possible dire consequences because many police officers in possession of conventional dart weapons mistakenly assume that these weapons are effective against most or many individuals.

Accordingly, it would be highly desirable to provide an improved apparatus and method which would, with a high degree of certainty, enable a police officer or other individual to incapacitate an attacker.

SUMMARY OF THE INVENTION

A method, according to various aspects of the present invention, is performed by a weapon, the weapon for halting locomotion of a human target. The method includes: charging a capacitor of the weapon; and discharging the capacitor through a transformer of the weapon to generate a pulse to be conducted through tissue of the human target. The pulse has a pulse width from 9 to 100 microseconds and charging provides from 0.8 to 10 joules of energy stored by the capacitor and discharged per pulse.

Another method, according to various aspects of the present invention, is performed by a weapon, the weapon for halting locomotion by a human target. The method includes: charging a capacitor of the weapon; and discharging the capacitor through a transformer of the weapon to generate in a secondary of the transformer a current comprising a recurring pulse to be conducted through tissue of the human target. Each recurring pulse has a pulse width from 9 to 100 microseconds. The current has a magnitude of from 100 to 500 milliamps RMS.

Another method, according to various aspects of the present invention, is performed by a weapon, the weapon for halting locomotion by a human target. The method includes generating a current to be conducted through tissue of the target, wherein the current comprises a plurality of recurring pulses during a period. Each recurring pulse has a pulse width of from 9 to 100 microseconds.

It is a principal object of the invention to provide an improved apparatus and method for halting the locomotion of a human being or other animal. Other objects and advantages of the invention will be apparent to those skilled in the art from the following detailed description and drawing.

BRIEF DESCRIPTION OF THE DRAWING

Embodiments of the present invention will now be further described with reference to the drawing, wherein like designations denote like elements, and:

FIG. 3 is a chart comparing prior art weapons to an embodiment of the present invention;

DETAILED DESCRIPTION OF PREFERRED EMBODIMENTS

Figure 1:
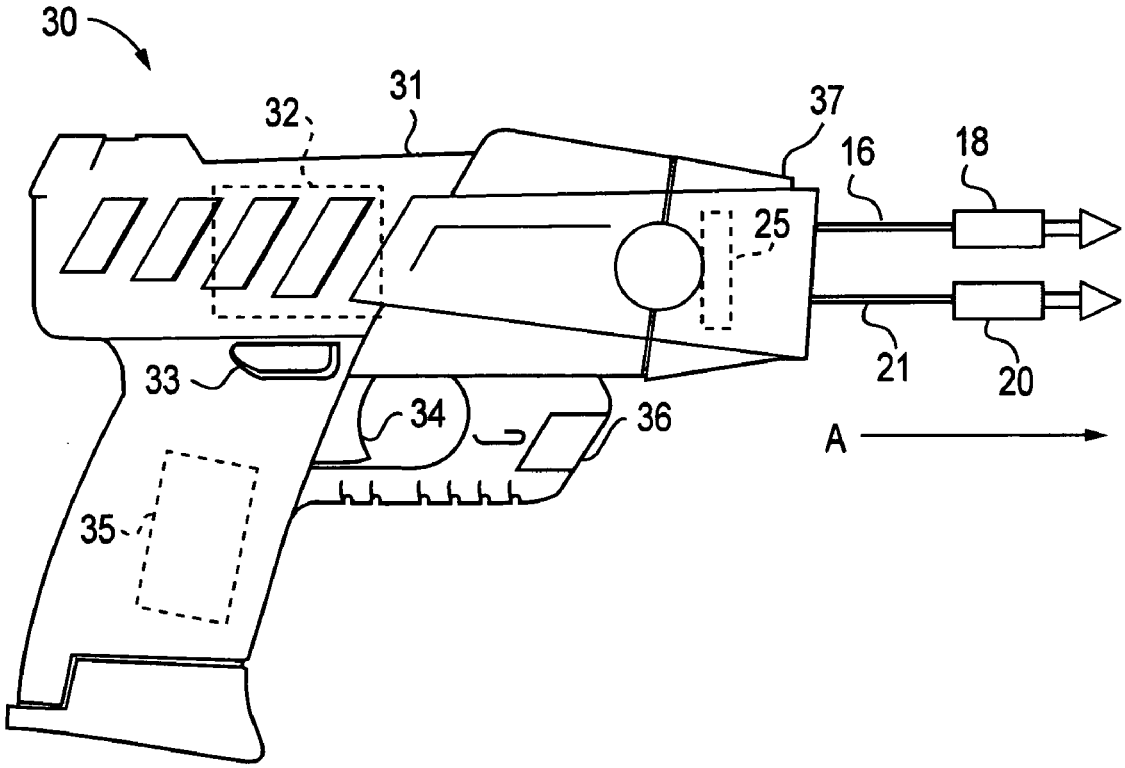
FIG. 1 illustrates a dart weapon constructed in accordance with various aspects of the present invention.

The drawing shows presently preferred embodiments of the invention for the purpose of illustrating the invention and not by way of limitation of the scope of the appended claims to the invention. FIG. 1 illustrates a dart weapon 30 constructed in accordance with the principles of the invention that includes housing 31, trigger 34 mounted in housing 31, microprocessor 32 mounted in housing 31, safety 33 mounted in housing 31, battery or batteries 35 mounted in housing 31, laser sight 36 mounted in housing 31, and cartridge 37 removably mounted to housing 31.

Cartridge 37 includes at least a first electrically conductive dart 18 and a second electrically conductive dart 20. Each dart 18 (20) is connected to cartridge 37 by an elongate electrically conductive wire 16 (21). Each wire 16 (21) typically is coiled in cartridge 37 and unwinds and straightens as dart 18 (20) travels through the air in the direction of arrow A toward a target. The length of each wire 16 (21) can vary but is typically 20 to 30 feet. Two or more cartridges 37 can be mounted on weapon 30.

Cartridge 37 also includes a powder charge 25, compressed air, or other motive power means for firing each dart 18 (20) through the air in the direction of arrow A toward a target. The powder charge, compressed air, or other motive power means utilized to fire a dart is well known in the art and will not be discussed in detail herein. Cartridge 37 is activated and the darts 18 and 20 are fired by manually sliding safety 33 in a selected direction to release safety 33 and then squeezing trigger 34. As will be described, the means for generating the electrical pulses which travel into wires 16 and 21 and darts 18 and 20 are also activated by squeezing trigger 34. Releasing safety 33 also activates or turns "on" laser sight 36 such that at least one laser beam projects outwardly in the direction of arrow A and impinges on the desired target.

Microprocessor 32 preferably includes memory and includes a sensor attached to trigger 34 or to some other desired portion of dart weapon 30 to generate for the memory in microprocessor 32 a signal each time trigger 34 is squeezed and weapon 30 is fired. Each time trigger 34 is squeezed and weapon 30 is fired, the memory in microprocessor 32 retains a record of the date and time the weapon was fired.

Figure 2:
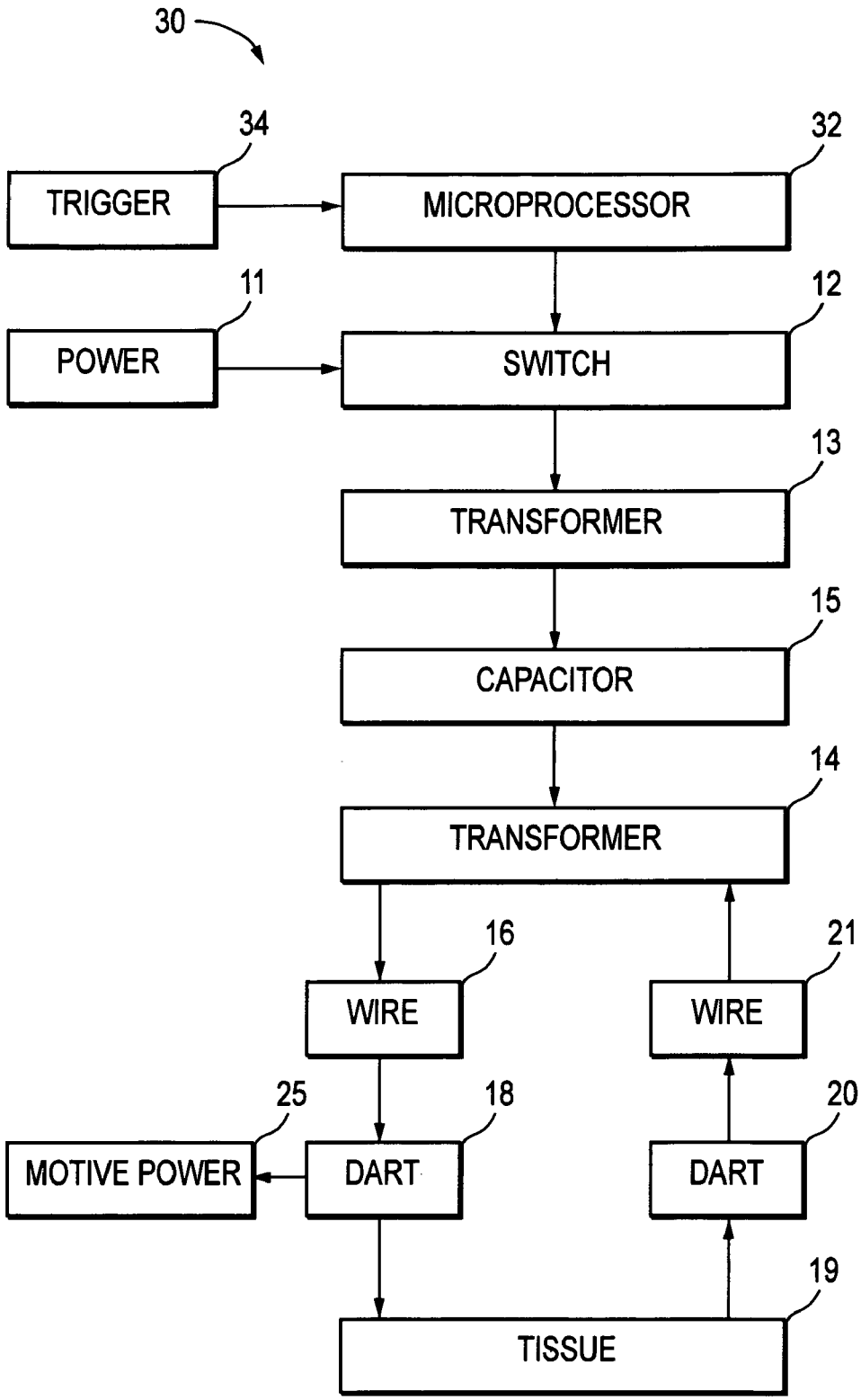
FIG. 2 is a block flow diagram of components of the dart weapon of FIG. 1.

In FIG. 2, power 11 is provided by nine-volt battery 35. Power 11 can be provided by any desired apparatus or means. Switch 12 ordinarily is "off". When trigger 34 is squeezed to fire weapon 30, a signal is generated which is received by microprocessor 32. Microprocessor 32 sends a signal to switch 12 to turn switch 12 "on" for about 7 seconds. Any mechanical or other means can be utilized in place of microprocessor 32 to operate switch 12. Switch 12 can be mechanical, constructed from semiconductor materials, or constructed from any other desired materials. When switch 12 is turned "on", it allows power 11 to travel to transformer 13.

Transformer 13 receives electricity from power 111 and produces a signal which causes 2,000 volts to be transmitted to capacitor 15. Once the voltage across capacitor 15 reaches 2,000 volts, it is able to discharge an electrical pulse into transformer 14. The pulse from capacitor 15 is a 0.80 to 10 joule pulse, and has a pulse width of 9 to 100 microseconds. Capacitor 15 produces 2 to 40, preferably about 5 to 15, pulses per second. A 0.88 microfarad capacitor is presently preferred, although the size of capacitor 15 can vary as desired. The voltage across capacitor 15 can vary as desired as long as the capacitor produces a pulse having 0.90 to 10 joules, preferably 1.5 to 5.0 joules.

Transformer 14 receives each pulse from capacitor 15 and produces a 50,000 volt pulse. The voltage of the pulse from transformer 14 can vary as desired as long as each pulse from transformer 14 has from 0.75 to 9 joules, preferably 1.0 to 3.0 joules, of energy, has a pulse width in the range of 10 to 100 microseconds, and has a current IRMS calculated as follows:

$$I_{RMS}=\sqrt{(I_{\mathrm{PEAK}})^2\cdot\mathrm{PulseWidth}\cdot\mathrm{Rate}} \quad (1)$$

This current is in the range of 100 to 500 milliamps. The pulse widths and currents of conventional dart weapons and non-dart electric weapons (commonly referred to as "stun guns") and of a dart weapon of the present invention are set forth in FIG. 3.

In the practice of the invention, it is critical to produce contractions of skeletal muscles sufficient to prevent the voluntary use of the muscles for normal locomotion of an individual's body. Twitching of the skin does not, as earlier noted, necessarily indicate that contractions of the skeletal muscles necessary to prevent locomotion are taking place. Producing contractions of smooth muscle is not sufficient in the practice of the invention. Contractions must instead be produced in striated skeletal muscles. Further, the contractions in the skeletal muscles must be sufficient to prevent voluntary use of the skeletal muscles by the individual (i.e., the muscles must lock up and not be operable). The electrical pulses produced by prior art dart weapons do not prevent the use of the skeletal muscles and do not prevent locomotion of an individual. It is not the object of the invention to cause all the skeletal muscles of an individual to lock up, but only some portion of the skeletal muscles.

Based on tests to date, the discomfort and loss of locomotion caused when skeletal muscles lock up in response to pulses produced by the apparatus of the invention is almost always sufficient to halt the locomotion of an individual. In actual tests, over 20 volunteers were each given the task of advancing to a target at least 5 feet away and of simulating an attack. Each test was repeated using the invention described herein. After being hit with darts from the weapon of the invention, each volunteer was immediately immobilized and dropped to the ground. None of the volunteers was able to advance toward or reach the target.

The profile of pulses used in prior art electric weapons is deficient in several respects. First, the energy produced by the pulses is in the range of 0.01 to 0.5 joule. This is outside the range of 0.9 to 10 joules required in each pulse produced in the apparatus of the invention. Second, the width of each pulse in prior art apparatus is about 1 to 7.5 microseconds. The pulse width in the apparatus of the invention must be 9 to 100 microseconds. Third, the current in each pulse produced by prior art apparatus is in the range of about 20 to 65 milliamps. The current in each pulse produced in the apparatus of the invention must be in the range of 100 to 500 milliamps. The pulses delivered to a target produce actual contractions of skeletal muscles sufficient to prevent use of the muscles by the individual subjected to the pulses.

If contractions of skeletal muscles are not produced, the apparatus of the invention is not functioning in the manner desired. If there are no contractions of the skeletal muscles, the individual can "walk through", or be trained to "walk through", being hit with darts which conduct electricity through the individual's body. If contractions of skeletal muscles are produced, but do not prevent voluntary use of the muscles by the individual subjected to the pulses, then the invention is not functioning as desired. If contractions of the skeletal muscles do not prevent voluntary use of the muscles by the individual, then the individual can "walk through", or be trained to "walk through", being hit with darts which conduct electricity through the individual's body.

In operation, again referring to FIG. 2, trigger 34 is pressed to send a signal to microprocessor 32. Microprocessor 32 turns "on" switch 12. Power 11 flows through transformer 13, capacitor 15, and transformer 14 in the manner discussed. The output from transformer 14 goes into wire 16 and dart 18. Once the current flow reaches dart 18, current from dart 18 is directed to motive power means 25 (i.e., black powder) to activate motive power means 25 to propel darts 18 and 20 through the air in the direction of arrow A to the individual who is the target. Darts 18 and 20 are fired simultaneously. When darts 18 and 20 contact the clothing of the individual near the individual's body or contact the individual's body, pulses from dart 18 travel into tissue 19 of the individual's body, from tissue 19 into dart 20, from dart 20 into wire 21, and through wire 21 to transformer 14. Pulses are delivered from dart 18 into tissue 19 for about 6 to 7 seconds. The pulses cause contraction of skeletal muscles and make the muscles inoperable, preventing use of the muscles in locomotion of the individual's skeleton.

Figure 4A:
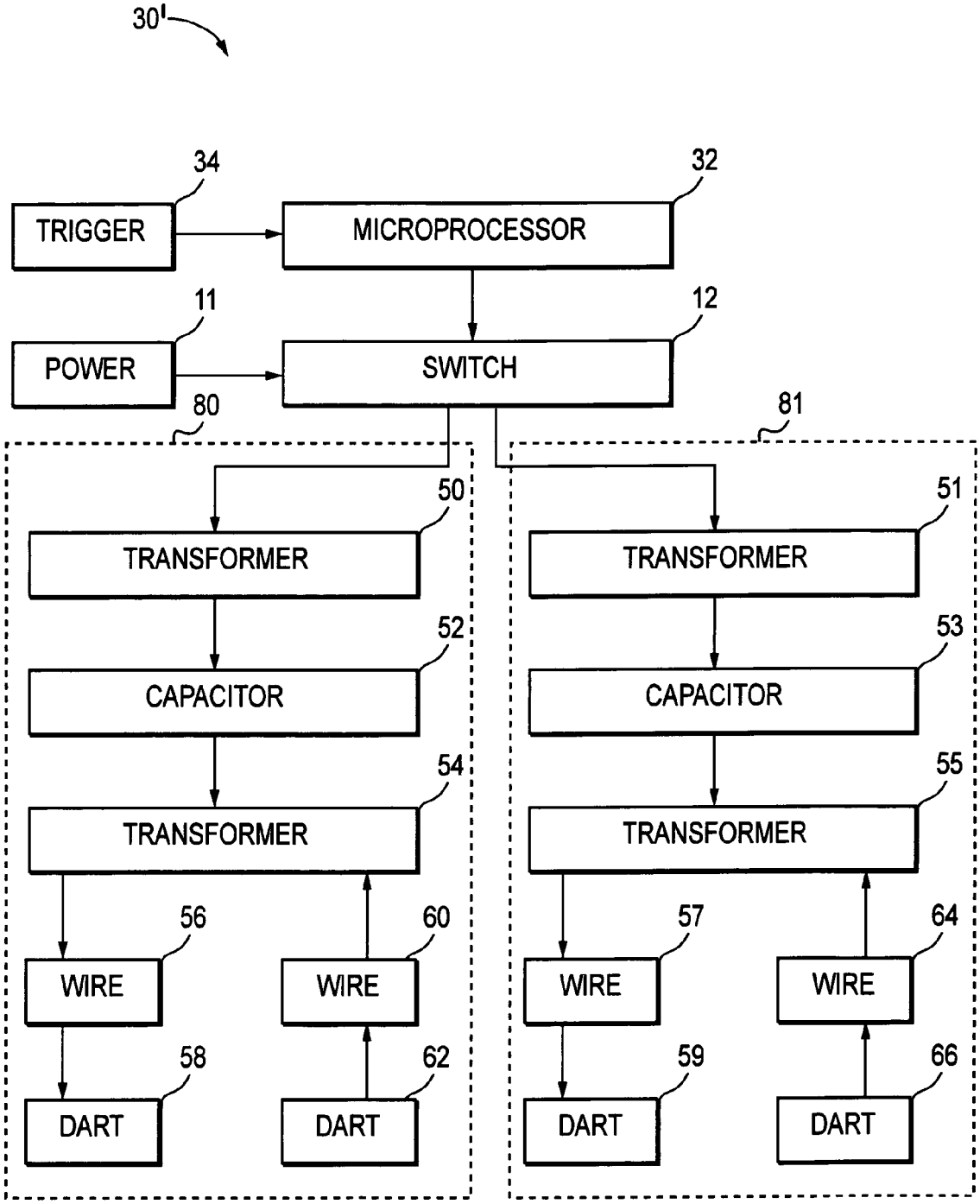
FIGS. 4A, 4B, and 4C are block flow diagrams illustrating other embodiments of the present invention.

In various embodiments of the invention, a dart weapon includes at least two cartridges. In the embodiment of FIG. 4A, dart weapon 30' includes cartridges 80 and 81. Cartridge 80 includes transformer 50, capacitor 52, transformer 54, wire 56 connected to transformer 54, first dart 58 connected to wire 56, wire 60, and dart 62 operatively associated with wire 56 and dart 58 and electrically coupled to transformer 54. Darts 58 and 62 are fired simultaneously. Dart 58 delivers electrical pulses to tissue (not shown) of an individual's body. Dart 62 receives electricity from the tissue and returns the electricity to the weapon via wire 60. Dart 58 is connected to motive power means (not shown) in cartridge 80 in much the same manner that dart 18 is connected to motive power means 25 in FIG. 2.

Cartridge 81 includes transformer 51, capacitor 53, transformer 55, wire 57 connected to transformer 55, dart 59 connected to wire 57, wire 64, and dart 66, operatively associated with wire 57 and dart 59, and electrically coupled to transformer 55. Darts 59 and 66 are fired simultaneously. Dart 59 delivers electrical pulses to tissue (not shown) of an individual's body. Dart 66 receives electricity from the tissue and returns the electricity to the weapon 30' via wire 64. Dart 59 is connected to motive power means in cartridge 81 in much the same manner that dart 18 is connected to motive power means 25 in FIG. 2.

When trigger 34 is depressed a first time, microprocessor 32 sends out a signal which causes switch 12 to route power to transformer 50 such that darts 58 and 62 are fired simultaneously into contact with a target individual's body and pulses are delivered into the target individual's body through dart 58. When trigger 34 is depressed a second time, microprocessor 32 sends out a signal which causes switch 12 to route power to transformer 51 such that darts 59 and 66 are fired simultaneously into contact with a target individual's body and pulses are delivered into the target individual's body through dart 59.

If desired, microprocessor 32 can be programmed such that switch 12 permits power 11 to flow simultaneously both to transformer 50 and to transformer 51 such that darts 58, 62, 59, and 66 are fired simultaneously. Consequently, another embodiment of the invention of FIG. 4A enables both pairs of darts to be fired either sequentially or simultaneously.

Figure 4B:
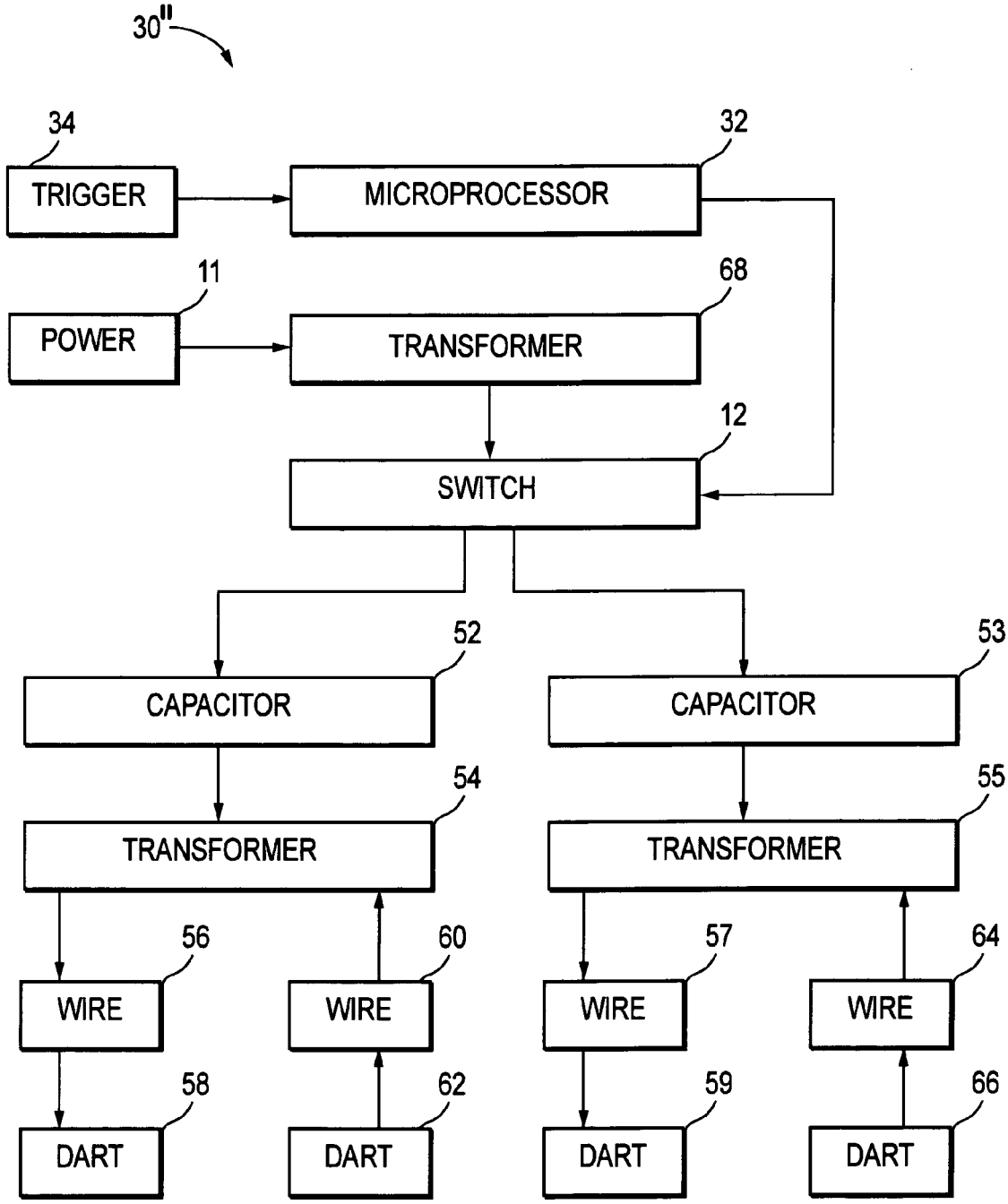

In the embodiment of the invention of FIG. 4B, one transformer 68 is utilized and switch 12 is coupled between transformer 68 and capacitors 52 and 53. In this embodiment, microprocessor 32 (or any other desired mechanical or other means) controls switch 12 so that when trigger 34 is squeezed to fire weapon 30", power 11 flowing through transformer 68 is directed by switch 12: (a) to capacitor 52 to fire darts 58 and 62; (b) to capacitor 53 to fire darts 59 and 66; or (c) simultaneously to capacitors 52 and 53 to fire darts 58, 62, 59, and 66 simultaneously.

Figure 4C:
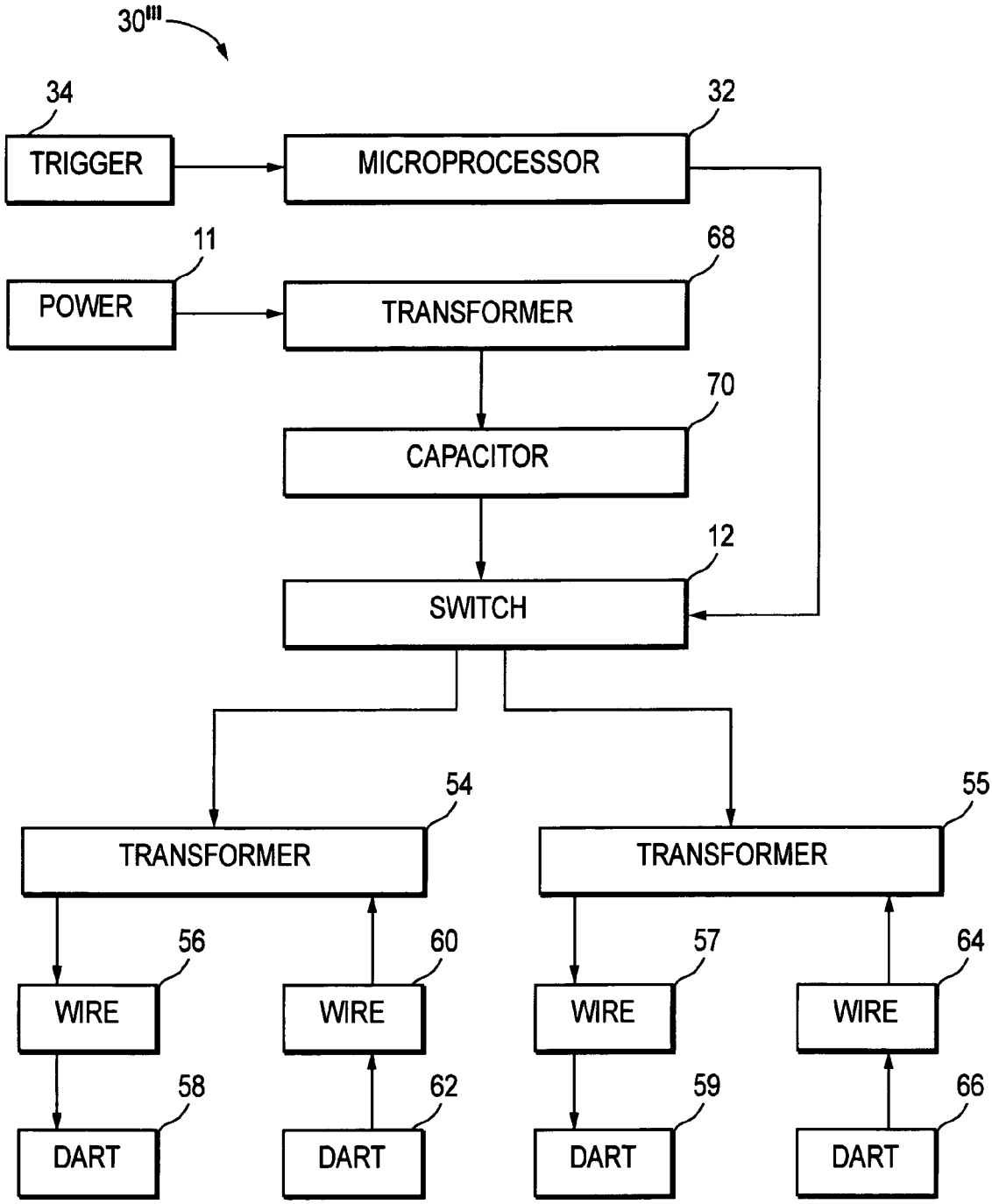

In the embodiment of the invention of FIG. 4C, one transformer 68 and one capacitor 70 are utilized, and switch 12 is coupled between capacitor 70 and transformers 54 and 55. In this embodiment, microprocessor 32 controls switch 12 so that when trigger 34 is squeezed to fire weapon 30'", power 11 flowing through transformer 68 and through capacitor 70 is directed by switch 12: (a) to transformer 54 to fire darts 58 and 62; (b) to transformer 55 to fire darts 59 and 66; or (c) simultaneously to transformers 54 and 55 to fire darts 58, 62, 59, and 66 simultaneously.

Figure 5:
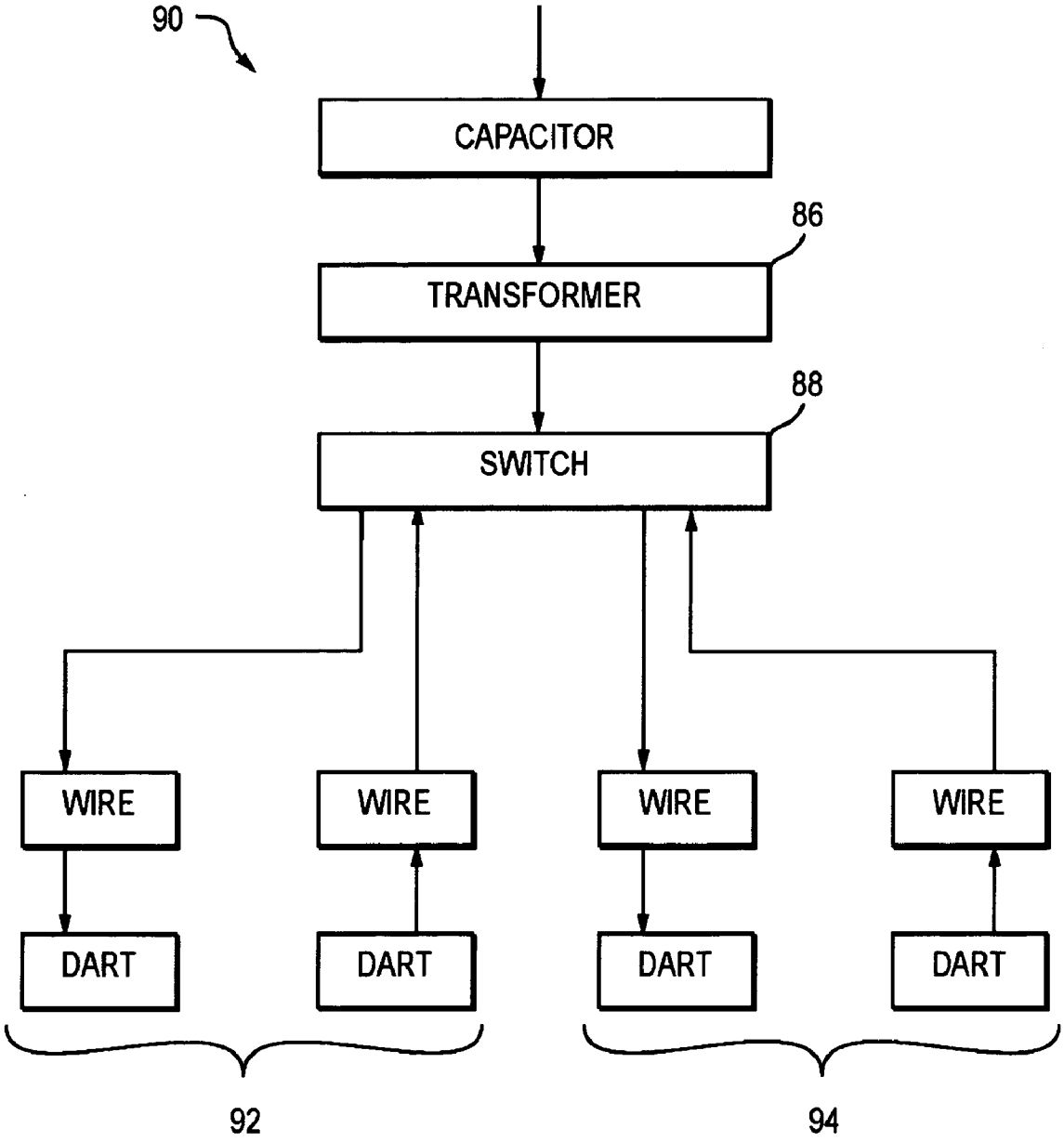
FIG. 5 (PRIOR ART)
FIG. 5 is a block flow diagram of a prior art weapon.

A particular advantage of the switching arrangements just discussed with reference to FIGS. 4A, 4B, and 4C is that the voltage being switched is much less than in prior art dart weapons. In a prior art dart weapon 90 of FIG. 5 transformer 86 and switch 88 are used. Switch 88 routes output from transformer 86 either to a first dart pair 92 or a second dart pair 94. Routing 50,000 volts is difficult, and in some cases both dart pairs 92 and 94 fire at the same time even though the 50,000 volts is routed to only one of the dart pairs.

Figure 6A:
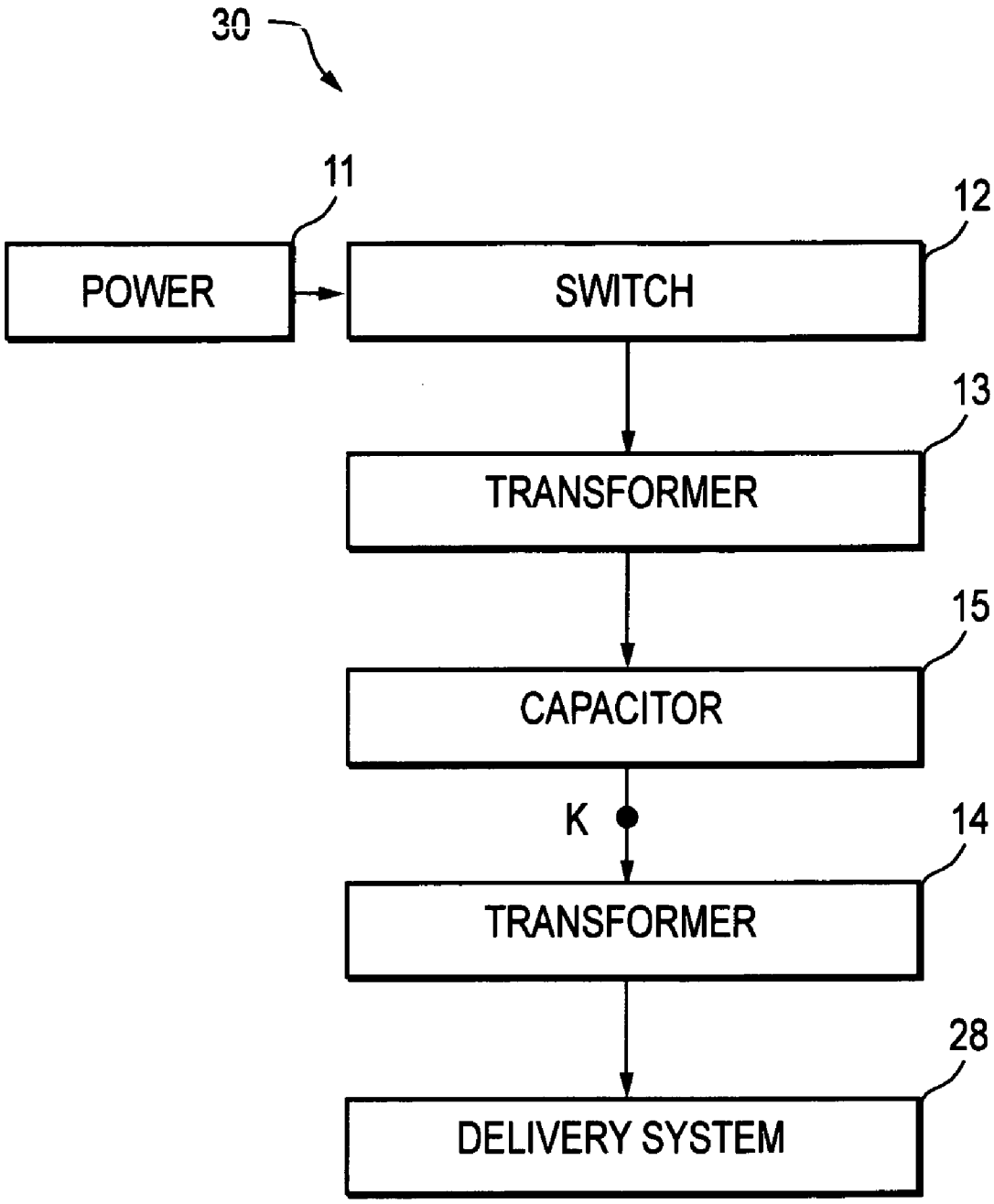
FIGS. 6A and 6B are block flow diagrams according to various aspects of the present invention.

An apparatus according to various aspects of the present invention is used for preventing locomotion by a living target by causing repeated involuntary contractions of skeletal muscles of the target. Referring to FIG. 6A, the apparatus includes: a housing; a first conducting unit; a second conducting unit; a power supply; and a delivery system 28. The first conducting unit transmits electrical energy in pulses from the first conducting unit to the target. The second conducting unit transmits electrical energy from the target to the apparatus. The power supply generates energy and includes capacitor 15 and transformer 14. Capacitor 15 delivers energy in pulses from capacitor 15 to transformer 14. Capacitor 15 produces and delivers (at K) to transformer 14 from 0.75 to 10 joules in each pulse from capacitor 15. Transformer 14 delivers electrical energy in pulses to the first conducting unit. Delivery system 28 contacts the target with at least a portion of each of the first and second conducting units such that pulses delivered from the first conducting unit to the target travel through at least a portion of the skeletal muscles to the second conducting unit, and produce contractions in the portion of the skeletal muscles which prevents the use by the target of the portion of the skeletal muscles.

Figure 6B:
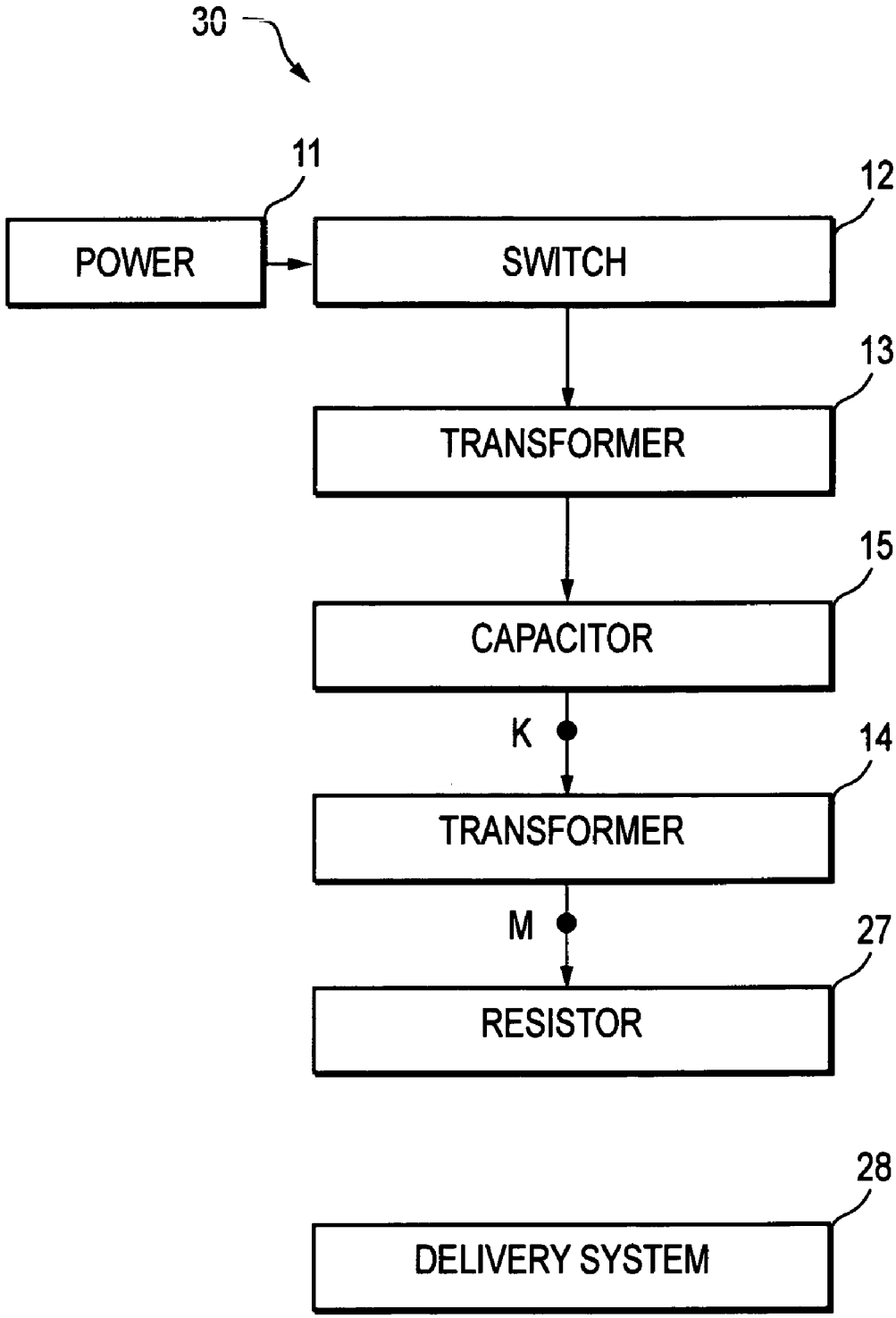

An apparatus according to various aspects of the present invention is used for preventing locomotion by a living target by causing repeated involuntary contractions of skeletal muscles of the target. Referring to FIG. 6B, the apparatus includes: a housing; a first conducting unit; a second conducting unit; a power supply, and a delivery system 28. The first conducting unit transmits electrical energy in pulses from the first conducting unit to the target. The second conducting unit transmits electrical energy from the target to the apparatus. The power supply produces electrical pulses which, if passed through a 1000 ohm resistor 27, each would have a pulse width (at M) greater than about 10 microseconds and a current in excess of 100 milliamps. The delivery system 28 contacts the target with at least a portion of each of the first and second conducting units such that pulses delivered from the first conducting unit to the target travel through at least a portion of the skeletal muscles to the second conducting unit and produce contractions in the portion of the skeletal muscles which prevents the use by the target of the portion of the skeletal muscles.

A method, according to various aspects of the present invention, is used for preventing locomotion by a living target by causing repeated involuntary contractions of skeletal muscles of the target. The method includes providing an apparatus and operating the activation system of the apparatus. The apparatus includes the apparatus discussed above with reference to FIG. 6A and further includes an activation system operable to activate the power supply, the first conducting unit, the second conducting unit, and the delivery system. The activation system is operated to contact the target with the first conducting unit and the second conducting unit, to deliver from the capacitor 15 to the transformer 14 pulses (at K) each containing 0.75 to 10 joules, and to deliver from the transformer to the first conducting unit electrical energy in pulses.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

I claim:

1. A method performed by a weapon, the weapon for halting locomotion by a human or animal target, the method comprising:

a. charging a capacitance of the weapon; and b. discharging 0.75 to 10 joules from the capacitance for 9 to 100 microseconds into a transformer of the weapon to generate a pulse to be conducted through tissue of the target;

whereby 2 to 40 of the pulses per second when conducted through tissue of the target halts locomotion by the target.

2. The method of claim 1 wherein the pulse provides from 1 to 3 joules of energy into a provided resistance of 1000 ohms.

3. The method of claim 1 wherein discharging provides from 1.5 to 5 joules of energy from the capacitance per pulse.

4. The method of claim 1 further comprising repeating discharging to generate respective pulses at a rate of from 5 to 15 pulses per second.

5. The method of claim 1 wherein the capacitance comprises a capacitor of about 0.88 microfarads.

6. The method of claim 1 wherein discharging begins after a voltage across the capacitance is about 2000 volts.

7. The method of claim 1 wherein the pulse provides a pulse width greater than 10 microseconds into a provided resistance of 1000 ohms.

8. The method of claim 1 wherein the pulse provides a pulse width of about 13 microseconds into a provided resistance of 1000 ohms.

9. The method of claim 1 further comprising repeating discharging to generate respective pulses that provide a current of 100 to 500 milliamps RMS into a provided resistance of 1000 ohms.

10. The method of claim 1 further comprising repeating discharging to generate respective pulses that provide a current greater than 100 milliamps RMS into a provided resistance of 1000 ohms.

11. The method of claim 1 further comprising repeating discharging to generate respective pulses that provide a current of about 162 milliamps RMS into a provided resistance of 1000 ohms.

12. A method performed by a weapon, the weapon for halting locomotion by a human or animal target, the method comprising:

a. charging a capacitance of the weapon; and b. discharging the capacitance through a transformer of the weapon to generate in a secondary of the transformer a current consisting essentially of a plurality of substantially equally spaced apart pulses to be conducted through tissue of the target, wherein each pulse has a pulse width from 9 to 100 microseconds and wherein the current has a magnitude of from 100 to 500 milliamps RMS; whereby 2 to 40 of the pulses per second when conducted through tissue of the target halts locomotion by the target.

13. The method of claim 12 wherein the current has a magnitude of from 100 to 500 milliamps RMS through a provided resistance of 1000 ohms in place of the target.

14. The method of claim 12 wherein at least one of the pulses has an energy of 0.75 to 9 joules.

15. The method of claim 12 wherein at least one of the pulses has an energy of 0.75 to 9 joules into a provided resistance of 1000 ohms.

16. The method of claim 12 wherein at least one of the pulses has an energy of 1 to 3 joules.

17. The method of claim 12 wherein at least one of the pulses has an energy of 1 to 3 joules into a provided resistance of 1000 ohms.

18. The method of claim 12 wherein the current has a magnitude of about 162 milliamps RMS into a provided resistance of 1000 ohms.

19. The method of claim 12 wherein at least one of the pulses has a pulse width of about 13 microseconds.

20. The method of claim 12 wherein at least one of the recurring pulses has a pulse width of about 13 microseconds into a provided resistance of 1000 ohms.

21. A method for halting locomotion by a human or animal target, the method comprising:

passing a current through tissue of the target, wherein the current comprises a plurality of recurring pulses during a period, each recurring pulse has a pulse width of from 9 to 100 microseconds, and each pulse has from 0.75 to 10 joules of energy; whereby the plurality of pulses when passed through tissue of the target halts locomotion by the target.

22. The method of claim 21 wherein each recurring pulse has an energy of from 0.9 to 10 joules into a provided resistance of 1000 ohms.

23. The method of claim 21 wherein each recurring pulse has an energy of from 1 to 3 joules.

24. The method of claim 21 wherein each recurring pulse has an energy of from 1 to 3 joules into a provided resistance of 1000 ohms.

25. The method of claim 21 wherein the current has a magnitude of from 100 to 500 milliamps RMS for the period.

26. The method of claim 21 wherein the current has a magnitude of from 100 to 500 milliamps RMS for the period through a provided resistance of 1000 ohms.

27. The method of claim 21 wherein each recurring pulse is generated from stored energy, the energy having a magnitude of from 0.75 to 10 joules per pulse.

28. The method of claim 23 wherein each recurring pulse is generated from stored energy, the energy having a magnitude of from 1.5 to 5 joules per pulse.

29. The method of claim 21 wherein the plurality of recurring pulses has a pulse repetition rate of from 2 to 40 pulses per second.

30. The method of claim 21 wherein the plurality of recurring pulses has a pulse repetition rate of from 5 to 15 pulses per second.

31. The method of claim 21 wherein at least one of the recurring pulses has a pulse width from 9 to 100 microseconds into a provided resistance of 1000 ohms.

32. The method of claim 21 wherein at least one of the recurring pulses has from 0.75 to 10 joules of energy into a provided resistance of 1000 ohms.

33. The method of claim 21 wherein the recurring pulses provide a current greater than 100 milliamps RMS into a provided resistance of 1000 ohms.

34. The method of claim 21 wherein the recurring pulses provide a current of about 162 milliamps RMS into a provided resistance of 1000 ohms.

35. A method for halting locomotion by a human or animal target, the method comprising:

passing a current of 100 to 500 milliamps RMS through tissue of the target, wherein the current consists essentially of a plurality of substantially equally spaced apart pulses during a period, each pulse having a pulse width of from 9 to 100 microseconds; whereby the plurality of pulses when passed through tissue of the target halts locomotion by the target.

36. The method of claim 35 wherein the current has a magnitude of from 100 to 500 milliamps RMS for the period through a provided resistance of 1000 ohms.

37. The method of claim 35 wherein each pulse has an energy of from 0.9 to 10 joules.

38. The method of claim 35 wherein each pulse has an energy of from 0.9 to 10 joules into a provided resistance of 1000 ohms.

39. The method of claim 35 wherein each pulse has an energy of from 1 to 3 joules.

40. The method of claim 35 wherein each pulse has an energy of from 1 to 3 joules into a provided resistance of 1000 ohms.

41. The method of claim 35 wherein each pulse is generated from stored energy, the energy having a magnitude of from 0.75 to 10 joules per pulse.

42. The method of claim 35 wherein each pulse is generated from stored energy, the energy having a magnitude from 1.5 to 5 joules per pulse.

43. The method of claim 35 wherein the plurality of pulses has a pulse repetition rate of from 2 to 40 pulses per second.

44. The method of claim 35 wherein the plurality of pulses has a pulse repetition rate of from 5 to 15 pulses per second.

45. The method of claim 35 wherein at least one of the pulses has a pulse width from 9 to 100 microseconds into a provided resistance of 1000 ohms.

46. The method of claim 35 wherein the pulses provide a current of about 162 milliamps RMS into a provided resistance of 1000 ohms.

* * * * *